US012279658B2

(12) United States Patent
Harrison

(10) Patent No.: US 12,279,658 B2
(45) Date of Patent: Apr. 22, 2025

(54) SYSTEM AND METHOD FOR MOISTURE ABSORBENCY

(71) Applicant: George Lowndes Harrison, Gadsdem, AL (US)

(72) Inventor: George Lowndes Harrison, Gadsdem, AL (US)

( * ) Notice: Subject to any disclaimer, the term of this patent is extended or adjusted under 35 U.S.C. 154(b) by 394 days.

(21) Appl. No.: 17/945,771

(22) Filed: Sep. 15, 2022

(65) Prior Publication Data

US 2023/0091122 A1 Mar. 23, 2023

Related U.S. Application Data

(60) Provisional application No. 63/245,351, filed on Sep. 17, 2021.

(51) Int. Cl.
*A41C 3/12* (2006.01)

(52) U.S. Cl.
CPC ..... *A41C 3/12* (2013.01)

(58) Field of Classification Search
CPC ..... A41C 3/12
USPC ..... 450/37
See application file for complete search history.

(56) References Cited

U.S. PATENT DOCUMENTS 5,980,359 A * 11/1999 Brown ..... A41C 3/08 450/23
5,998,693 A * 12/1999 Zagame ..... A41C 3/065 450/81
7,404,752 B1 * 7/2008 Karon ..... A41C 3/12 450/37
7,905,763 B1 * 3/2011 Frank ..... A61F 13/141 450/37
8,075,367 B2 * 12/2011 Taylor ..... A41C 3/10 2/57
9,005,177 B2 * 4/2015 Krasikoff ..... A61F 13/141 604/386
9,687,395 B2 * 6/2017 Clarke ..... A41D 31/125
9,961,946 B2 * 5/2018 Calhoun ..... A41C 3/144
10,104,919 B2 * 10/2018 Perl ..... A41D 27/12
10,376,419 B2 * 8/2019 Lilien ..... A41C 3/144
2008/0004588 A1 * 1/2008 Gavitt ..... A61F 13/145 604/385.07
2012/0157951 A1 * 6/2012 Johnson ..... A41D 27/12 604/368
2014/0302745 A1 * 10/2014 Golubovic ..... A61F 13/145 450/1
2017/0000194 A1 * 1/2017 Huyghe ..... A41C 3/0035

* cited by examiner

*Primary Examiner* — Gloria M Hale
(74) *Attorney, Agent, or Firm* — Accelerate IP LLC

(57) ABSTRACT

An inframammary pad comprising first component, and a second component. The first component is half-cup shaped to generally conform to the underside of a female breast. The second component is also half-cup shaped to generally conform to the first component. The first and second components are foldably attached at their respective bottoms. When used with a brassiere, the first component can be placed on the inner lower portion of the cup of the brassiere with the fold proximal to the underwire (or band if brassiere is wireless) and the second component folds up over the outer lower portion of the cup of the brassiere such that the brassiere is sandwiched between the first and second components.

20 Claims, 4 Drawing Sheets

SYSTEM AND METHOD FOR MOISTURE ABSORBENCY

CROSS REFERENCE TO RELATED APPLICATIONS

The present application claims the benefit under 35 U.S.C. 119 of U.S. Provisional Patent Application Ser. No. 63/245,351 filed Sep. 17, 2021. The U.S. Provisional Patent Application Ser. No. 63/245,351 is hereby incorporated by reference in its entirety.

TECHNICAL FIELD

The present specification relates to absorbent or wicking pads, more particularly pads for absorbing and wicking sweat from a user.

BACKGROUND

Contact between the adjacent skin surfaces of the female breast and the chest or torso area are conducive to and often create perspiration. This chronically moist, anaerobic environment can quickly become acidic. This can lead to bacterial overgrowth and opportunistic fungal infections (such as intertrigo), both of which can lead to embarrassing odor. *Candida* is the most common commensal skin organism and is the most common organism responsible for infection. These infections typically manifest as a bright red maculopapular rash, which can span the entire breath of the breast fold. It is often associated with smaller satellite lesions, which contribute to its rapid progression along the weakened skin areas. *Candida* infections can be pruritic (unbearably itchy) and painful. If left untreated, they can cause frank skin breakdown. Tears and fissures can then develop. This makes the skin now susceptible to stubborn bacterial infections including the dreaded methicillin-resistant *Staphylococcus aureus* (MSRA) among others. Poor hygiene, poor nutrition and obesity compound these problems. Risk factors for MRSA include implanted medical devices, being hospitalized or being a resident of a long-term care facility. These compound infections can lead to serious deep skin/wound infections such as boils or abscesses. If not surgically attended to, the infection can burrow and infect deep tissues such as muscle, bone or joints. If the patient is immune compromised, they can even infect the bloodstream (sepsis), which can be fatal.

Numerous factors affect the degree of diaphoresis underneath the breast. Such factors include breast size, obesity, humidity, environmental climate, warm seasonal climate, physical activity, and increased breast size due to pregnancy or nursing. Regardless of which factors create the diaphoresis, if the perspiration remains trapped underneath the breast, problems as described above begin to occur.

While various pads have been developed to respond to other types of diaphoresis or moisture problems (e.g., underarm shields, sanitary napkins, etc.) none have been developed with enough flexibility to address the needs of women suffering from breast perspiration. It is acknowledged that other devices have been developed for under the breast, but the current products are purposefully relatively thick and bulky and intended for cosmetic, uplift purposes and not for medicating and soaking away moisture from the breast.

Therefore, a need exists for a perspiration absorbent pad particularly adapted for use by a multitude of women of all shapes and sizes for use in absorbing under breast perspiration and medicating the breast at the same time.

SUMMARY

Aspects disclosed herein comprise inframammary pads which may be placed between the overlying breast and the adjacent chest area to separate these portions of the anatomy to prevent chafing and other irritation. They also absorb perspiration in the immediate area which provides greater comfort and flexibility to women using the pad providing comfort and relief from irritation from the underside of the breast Aspects disclosed herein comprise an absorbent pad comprising two components. The first component is generally half-cup shaped to conform to the inner side of the lower half of the cup portion of a brassiere. The second component is generally half-cup shaped to conform to the outer side of the lower half of the cup portion of a brassiere. The two components are fold-ably connected at the bottom, such that when folded they sandwich the lower half of the cup portion of the brassiere. Each of the two components are comprised of at least one layer. They also have an occlusive surface, which will interface with the brassiere, and a contact surface which can be proximal to the skin. The at least one layer can comprise a permeable, non-permeable, non-stick, moisture absorbing, moisture wicking, odor neutralizing, deodorizing, hypoallergenic, anti-microbial, anti-bacterial, bactericidal, bacteriostatic, anti-fungal, fungistatic, fungicidal materials, and/or the like. The contact surface can be a permeable non-stick material. The occlusive surface can be a non-permeable material. The pad can also comprise an attaching or securing device such as high friction material, magnets, clips, snaps, hooks, hook and loop, bending wires, clamps, pins, ties, adhesive, and/or the like. If the securing device comprises adhesive, then the adhesive can have a removable backing. The pad layer(s) can be impregnated with scents, deodorizers, antibacterial, antifungal, bacteriostatic, fungistatic agents, and/or the like. The pad can be disposable, or reusable. The pad can be constructed to be thin and indiscernible, and/or it can be constructed to be maximally absorbent. The pad can be made in a variety of sizes, such as, for example, standard brassiere sizes.

In one or more embodiments the pad would not be reliant on a brassiere.

The method of wicking moisture from the skin using a pad, the method comprising providing at least one layer. In one embodiment the at least one layer can be contact layer comprised of permeable non-stick materials. The contact layer can be coupled to an absorbent layer, which can be comprised of absorbable materials. The absorbent layer can be coupled to an occlusive layer, which can be comprised of non-permeable materials. A securing device can be provided. The method can further comprise the step of impregnating one or more layers with scents, deodorizers, antibacterial, antifungal, bacteriostatic, or fungistatic agents.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the above.

Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for" and will also recite the word "function" (i.e., will state "means for performing the function of . . . , without also reciting in such phrases any structure, material or act in support of the function. Thus, even when the claims recite a "means for performing the function of molding a . . . , step for performing the function of . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
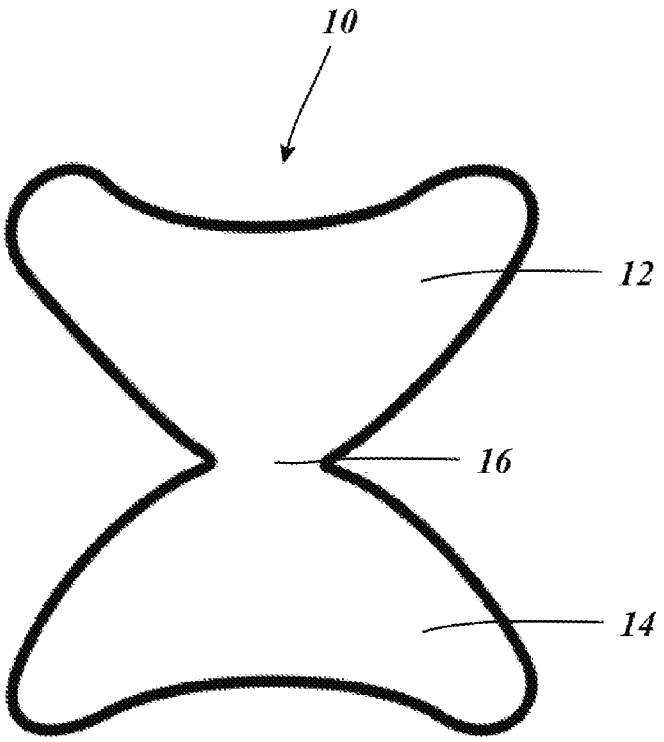
FIG. 1 is a top view of one embodiment of an unfolded moisture absorbency pad in accordance to one, or more embodiments.

Referring to FIG. 1 a moisture absorbency pad, shown generally at 10. The pad 10 can comprise two components, a first component 12 and a second component 14 wherein the first component and the second component can be foldably attached together at least one of their sides creating a fold 16 wherein the first component and second component can be one continue piece of material or can be multiple pieces attached together by such as, for example, stitching, tape, glue, or the like. The thickness of the pad 10 can be consistent, or it can be thinner at the fold 16 to aid in folding. In one or more embodiments the first component 12 can be substantially half-cup shaped to generally conform to the lower half of the female breast. Similarly, the second component 14 can be shaped to conform to the first component 12. When used with a brassiere the first component 12 and the second component 14 can sandwich the approximate lower half of the cup of the brassiere creating a barrier between the brassiere and the breast. In other embodiments the first component or the second component can be omitted and the first or second component can fold over on itself creating a barrier between the brassiere or clothing and the breast. The first component and the second component can be any suitable shape but in the preferred embodiment the first component and the second component can be a half cup shape allowing for general conformity to the breast.

Figure 2:
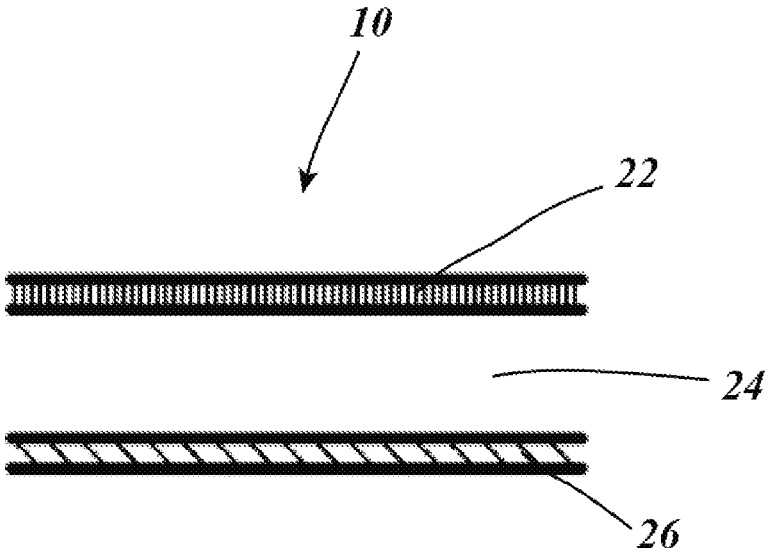
FIG. 2 is a side view of one embodiment of an unfolded moisture absorbency pad in accordance to one, or more embodiments.

Referring now to FIG. 2 a cross section view of the pad 10. The first component 12 and the second component 14 can further comprise at least two layers wherein in the preferred embodiment, the layers can be a first layer 22, a second layer 24 and a third layer 26. The first layer 22 can come into contact with the user's skins such as the user's chest wall and the skin of the breast. The first layer 22 can be permeable or porous layer which can allow liquids to flow to the second layer 26. The first layer 22 can substantially connect or contain the second layer 26 to the third layer 26 wherein the first layer and the third layer sandwich the second layer between the layers encapsulating the second layer. The first layer 22 can be impregnated, printed, or layered with antimicrobial material such as silver, zinc, graphene, bactericides, fungal inhibitors, or the like. In certain embodiments, the first layer 22 can be treated or impregnated with such as, from example, an anti-fungal, medication, antiperspirant, bactericidal, bacteriostatic, fungistatic, hypoallergenic, deodorizing, odor neutralizing, or the like treatment by adhesion, printing, spraying or any method known in the art to apply, impregnate, or treat a material with another element. Some specific examples contemplated are activated charcoal, miconazole nitrate, ZEASORB AF™, and metronidazole, but any compositions with the desired properties are also considered. The first layer 22 can be the surface proximal to a user's skin when in use.

In embodiments, the second layer 24 can be substantially attached to or connected to the first layer 22 and the third layer 26. The second layer 24 can be an absorbent material such as, for example, cotton, modal, synthetic, micro-modal, Tencel@, Alginates, including woven and non-woven materials, or any material that can absorb or wick away liquids from the skin. The second layer 24 can have a thickness of such as, for example, at least 1 mm, at least 2 mm, at least 3 mm, at least 4 mm, at least 5 mm, or the like. In certain embodiments, the second layer 24 can substantially take the form of the brassiere or when placed against the user's skin the second layer can substantially support the shape or form of the inframammary pad 10. In other embodiments the second layer 24 can be a supportive structure layer wherein it can be a thicker material that can be formed into the shape of a breast or other part of the human body wherein the second layer can be formed to any user's shape and size. In embodiments, the pad 10 is not limited to the use of a user's breast, but can be used on any part of a human body where sweet and bacteria grow and need to be wicked away and treated.

The third layer 26 can be an occlusive wherein it can act as a barrier or insulative layer. The third layer 26 can attached to the second layer by adhesive, or similar method of attaching materials together. The third layer 26 can be the surface proximal to the brassiere or other type of clothing wherein the brassiere can be placed between the first component 12 and the second component 14. The third layer 26 can be made of non-permeable, non-stick, odor neutralizing, deodorizing, or the like. The third layer 26 can be impregnated with scented, deodorizing, antibacterial, antifungal, bacteriostatic, fungistatic agents, and/or the like. In certain embodiments, the third layer 26 can have an adhesive backing to removably attach itself to the brassiere or other clothing. The third layer 26 can have a coating to seal in the liquid collected by the second layer 24.

In embodiments, the moisture absorbency pad 10 can be made of disposable and/or re-usable materials.

Figure 3:
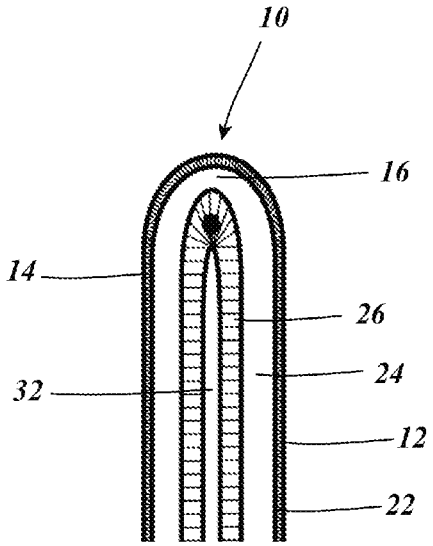
FIG. 3 is a side view of one embodiment of a folded unfolded moisture absorbency pad in accordance to one, or more embodiments.

Referring now to FIG. 3 the first component 12 and second component 14 can be folded together creating a cavity 32. If used with a brassiere, the components are folded over the brassiere such that the first component 12 and second component 14 can be sandwiched with at least a portion of the lower half of the cup of the brassiere within the cavity 32. If used with a band, the components are folded over the band such that the lower portion of the first component 12 and the second component 14 can sandwich a portion of the band in cavity 32 wherein the band can support the pad 10 and keep it in place when on the user.

The brassiere 42 can be a sports bra, bra, lingerie, shirt, pants, blouse, or any other piece of clothing that the pad 10 can be attached to.

Figure 5:
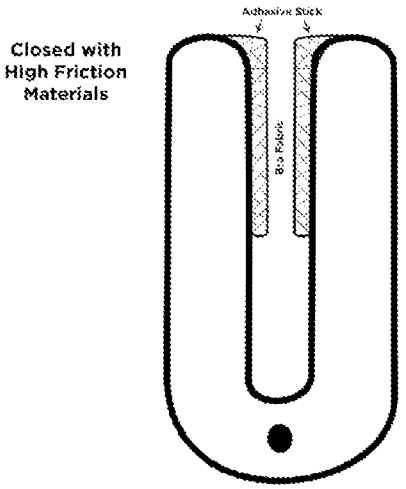
FIG. 5 shows one embodiment of a moisture absorbency pad attachment system using adhesive.
Figure 6:
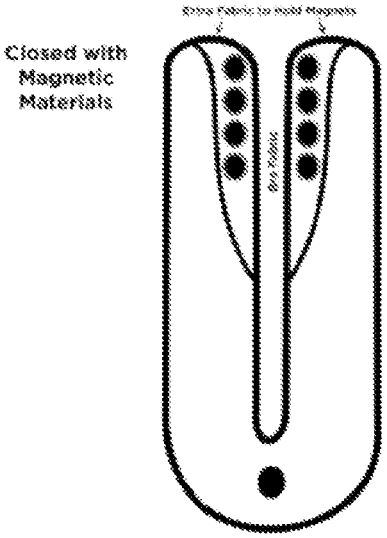
FIG. 6 shows another embodiment of a moisture absorbency pad attachment system using magnets.
Figure 7:
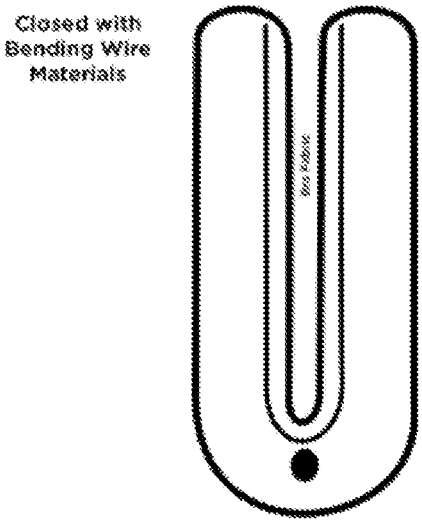
FIG. 7 shows another embodiment of a moisture absorbency pad attachment system using wires.
Figure 8:
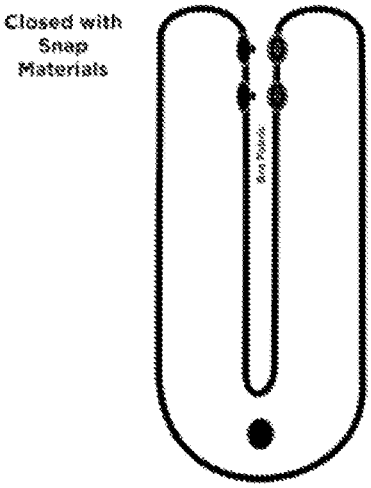
FIG. 8 shows another embodiment of a moisture absorbency pad attachment system using snaps.

The first component 12 and the second component 14 can be anchored or secured onto the brassiere to keep the moisture absorbency pad 10 in place. The first component 12 and the second component 14 can be secured to each other, to the user's skin, to the brassiere, the brassiere's band, or the like. The first component 12 and the second component 14 can be secured using any securing means, such as, for example, high friction materials, magnets as shown in FIG. 6, clips, snaps as shown in FIG. 8, hooks, hook and loop, bending wires as shown in FIG. 7, clamps, pins, ties, adhesive as shown in FIG. 5, or the like. In certain embodiments the third layer 26 can have an adhesive backing wherein the adhesive backing can have a removable protected covering until use. In other embodiments, the anchors can keep the inframammary pad 10 securely in place but can easily and quickly be changeable in any location, such as a public restroom. The moisture absorbency pad 10 can be made to be varying thicknesses and absorbencies to offer a variety of solutions such as, for example, being indiscernible to others, having maximum absorbency, and/or the like. The inframammary pad 10 can be of varying sizes, such as, for example, standard brassiere sizes, or the like.

Figure 4A:
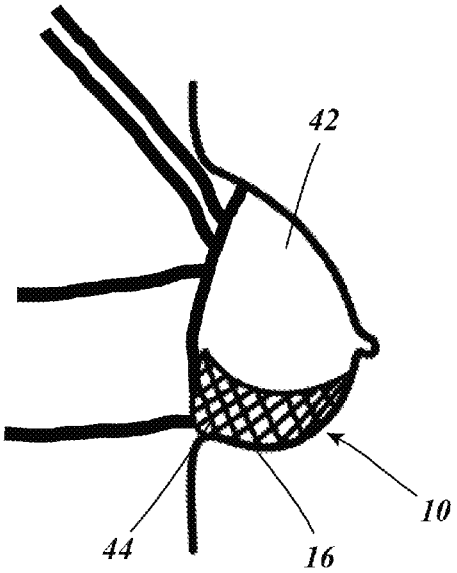
FIG. 4*a* is a side view of an example installation with a brassiere of one embodiment of an moisture absorbency pad in accordance to one, or more embodiments.
Figure 4B:
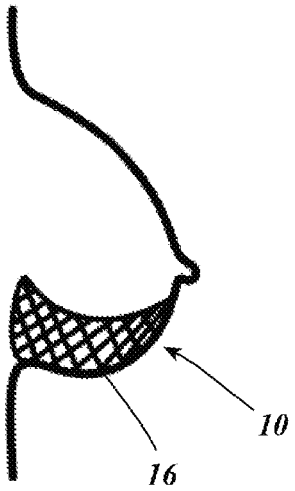
FIG. 4*b* is a side view of an example installation without a brassiere of one embodiment of an moisture absorbency pad in accordance to one, or more embodiments.

FIG. 4*a* shows one embodiment of an moisture absorbency pad 10 in use. The first component's 12 third layer 26 can be placed on the inner side of the lower portion of the cup of a brassiere 42. The second component 14 can be folded up so that the fold 16 is proximal to the underwire 44 (or lower band if the brassiere is wireless) of the brassiere 42, and the third layer 26 of the first component 12 and second component 14 sandwich at least a part of the lower portion of the cup of the brassiere 42. The first component 12 and the second component 14 can be secured to the brassiere. In certain embodiments, the pad 10 can be used without a brassiere as shown in FIG. 4*b*. The second component's 14 third layer 26 surface is folded up onto the first component's third layer. The first component 12 and the second component 14 can be secured to each other. The fold 16 of the moisture absorbency pad 10 can be proximal to the point where the breast and chest wall meet.

These and other embodiments place the moisture absorbency pad 10 between the overlying breast and the adjacent chest area, separating these portions of the anatomy preventing chafing, irritations, and skin conditions. The pad can also absorb perspiration in the immediate area, thereby providing greater comfort the user and an environment less susceptible to bacteria, fungus, yeast, and the like.

The moisture absorbency pad 10 is described as being shaped for a female breast, but it should be understood that the same general shape can be useful for male anatomy, especially on obese males in the pectoral region. The moisture absorbency pad 10 can also be used in other areas of the body regardless of gender, such as the perineal, axilla, armpit, pannus, and/or the like.

In one or more embodiments the moisture absorbency pad 10 first component 12 can be shaped to more closely conform to the area or crease where the armpit and front shoulder meet, or the axilla. The second component 14 can be shaped to conform to the first component. The first and second component can be secured to each other. Alternatively, the first and second components can sandwich a band that can go around the chest area, the upper arm, and/or the like, to secure the pad 10 to the axilla area to aid in protecting, medicating, and/or caring for the axilla area.

In one or more embodiments that moisture absorbency pad 10 first component 12 can be shaped to more closely conform to the folds in the belly that large people have, or the pannus. The second component 14 can be shaped to conform to the first component 12. The first and second components can be secured to each other. Alternatively, the first and second components can sandwich a band that can go around the belly area to secure the pad 10 to the pannus area to aid in protecting, medicating, and/or caring for the pannus area.

In one or more embodiments the moisture absorbency pad 10 could be provided in a kit for caregivers, such as, for example, long term care facilities, hospitals, doctor offices, clinics, home health, and/or the like. The kit can contain a variety of embodiments of the inframammary pad 10 such as, for example, a variety of shapes, a variety of medications, a variety of absorbencies, a variety of securing devices, and/or the like It is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. A moisture absorbency pad for use with a brassiere for a user having skin, the brassiere having a cup portion that has a lower half that has an inner side and an outer side, the absorbency pad comprising:

a first component and a second component wherein the first component is generally half-cup shaped to generally conform to the inner side and the second component is generally half-cup shaped to generally conform to the outer side;

a first bottom of the first component is integrally foldable to a second bottom of the second component such that when folded the two components sandwich at least a portion of the lower half, wherein the first and second components are comprised of at least one layer having an insulative or barrier surface to interface with the brassiere and a contact surface as being configured to interface with the skin surface of the user.

2. The pad of claim 1 wherein the first component and the second component have at least three layers wherein the layers are a first layer, second layer and a third layer.

3. The pad of claim 2 wherein the first layer, second layer and third layer are at least one of permeable, non-permeable, non-stick, moisture absorbing, moisture wicking, odor neutralizing, deodorizing, hypoallergenic, anti-microbial, antibacterial, bactericidal, bacteriostatic, anti-fungal, fungistatic, or fungicidal materials.

4. The pad of claim 2 wherein the first layer is a permeable non-stick material and second layer is an absorbent material.

5. The pad of claim 4 wherein the third layer is a non-permeable material.

6. The pad of claim 1 wherein the pad also comprises a securing device.

7. The pad of claim 6, wherein the securing device is high friction material, magnets, clips, snaps, hook, hook and loop, bending wires, clamps, pins, ties, or adhesive.

8. The pad of claim 7 wherein the adhesive has a removable backing.

9. The pad of claim 1 wherein the at least one layer is impregnated with at least one of scents, deodorizers, antibacterial, antifungal, bacteriostatic, or fungistatic agents.

10. The pad of claim 1 wherein the at least one layer is comprised of disposable or re-usable materials.

11. An absorbent pad for use with a person having skin and a breast with an underside, the absorbent pad comprising a first component that is generally half cup-shaped to generally conform to the underside and a second component that is generally half cup-shaped and generally conforms to the first component, wherein the first and second components are comprised of at least one layer; and wherein the first component comprises a first bottom, a first insulative or barrier surface, and a first surface that will be proximal to the skin and the second component comprises a second bottom, a second insulative or barrier surface, and a second contact surface that is configured to interface with the skin and wherein the first bottom is integrally foldable to the second bottom at a fold.

12. The pad of claim 11 wherein the at least one layer comprises at least one of permeable, non-permeable, non-stick, moisture absorbing, moisture wicking, odor neutralizing, deodorizing, hypoallergenic, anti-microbial, anti-bacterial, bactericidal, bacteriostatic, anti-fungal, fungistatic, or fungicidal materials.

13. The pad of claim 11 wherein the at least one layer comprises a first layer and a second layer and the first layer comprises a permeable non-stick material and the second layer comprises an absorbent material.

14. The pad of claim 11 wherein the third layer comprises a non-permeable material.

15. The pad of claim 11 wherein the pad also comprises a securing device.

16. The pad of claim 15 wherein the securing device is high friction material, magnets, clips, snaps, hook, hook and loop, bending wires, clamps, pins, ties, or adhesive.

17. The pad of claim 16 wherein the adhesive has a removable backing.

18. The pad of claim 11 further comprising a band for holding the pad in place more securely.

19. The pad of claim 11 wherein the at least one layer is impregnated with scents, deodorizers, antibacterial, antifungal, bacteriostatic, or fungistatic agents.

20. The pad of claim 11 wherein the at least one layer is comprised of disposable or re-usable materials.

* * * * *